United States Patent [19]

Heinemann et al.

[11] Patent Number: 4,681,021

[45] Date of Patent: Jul. 21, 1987

[54] DRIVING APPARATUS

[75] Inventors: Otto Heinemann, Ennigerloh; Heinz-Herbert Schmits, Rheda-Wiedenbrück, both of Fed. Rep. of Germany

[73] Assignee: Krupp Polysius AG, Beckum, Fed. Rep. of Germany

[21] Appl. No.: 860,444

[22] Filed: May 7, 1986

[30] Foreign Application Priority Data

May 31, 1985 [DE] Fed. Rep. of Germany ..... 3519565

[51] Int. Cl.[4] ..... F01L 15/00; F15B 15/22

[52] U.S. Cl. ..... 91/178; 91/325; 91/401; 91/410; 91/520; 60/579; 60/581

[58] Field of Search ..... 91/181, 178, 191, 192, 91/325, 348, 350, 357, 401, 402, 410, 520; 60/547.1, 579, 581, 593

[56] References Cited

U.S. PATENT DOCUMENTS

| | | | |
|---|---|---|---|
| 2,197,428 | 4/1940 | Erb | 91/192 X |
| 4,567,727 | 2/1986 | Grams | 60/581 X |

FOREIGN PATENT DOCUMENTS

| | | | |
|---|---|---|---|
| 3205666 | 8/1983 | Fed. Rep. of Germany | 60/579 |
| 3337143 | 4/1985 | Fed. Rep. of Germany . | |
| 1018161 | 12/1952 | France | 60/191 |
| 1289212 | 2/1962 | France | 91/401 |
| 462615 | 11/1966 | Japan | 60/581 |

*Primary Examiner*—Robert E. Garrett
*Assistant Examiner*—Mark A. Williamson
*Attorney, Agent, or Firm*—Learman & McCulloch

[57] ABSTRACT

A driving apparatus for producing a to-and-fro movement and having four plunger cylinders and four external non-return valves. Such driving apparatus is distinguished by a particularly simple construction.

4 Claims, 2 Drawing Figures

DRIVING APPARATUS

The invention relates to driving apparatus for producing to-and-fro movements of a driven machine part.

SUMMARY OF THE INVENTION

For the production of a to-and-fro movement of a driven machine part, for example the drive shaft of a thrust grate cooler, driving mechanisms are known which contain synchronized cylinders in which a piston rod is provided in the cylinder on both sides of the piston in order to create stroke volumes of equal size and thus exactly equal conditions for both stroke movements.

Furthermore, the subject matter of German Specification No. A-33 37 143.1 is a driving apparatus which contains four differential cylinder-piston arrangements and represents a considerable simplification by comparison with the driving devices having synchronized cylinders.

The object of the invention is to provide driving apparatus of the type referred to which achieves an even greater simplification by comparison with the prior art. In particular, apparatus according to the invention makes use of cylinders which are of simple design and have no internal valves so that only a small number of easily replaceable seals are necessary.

In driving apparatus according to the invention structurally simple plunger cylinders are used which are considerably more economical than synchronized cylinders and differential cylinders. Only one set of sealing rings per cylinder is necessary, and in addition these seals can be replaced quickly and easily.

In contrast to the known synchronized cylinders with built-in mechanically actuated scavenging valves, the driving apparatus according to the invention has the advantage that no internal valves are necessary. A further advantage is that a distance measuring system can be built into the cylinders if necessary.

The driving apparatus according to the invention is also distinguished by an improved introduction of force into the driven machine part, for example a thrust grating cooler, and by a generally simplified overall construction.

THE DRAWINGS

A presently preferred embodiment of the invention is illustrated in the drawings, in which:

FIG. 1 is a diagrammatic view of the driving apparatus during one working operation; and FIG. 2 is a similar diagram of the driving apparatus during the scavenging operation after completion of the working stroke.

DETAILED DESCRIPTION

The illustrated driving apparatus serves to produce a to-and-fro movement of a driven machine part which, in the illustrated embodiment, is the drive shaft 1 of a thrust grating cooler. The movement of this drive shaft 1 is represented by the double headed arrow 2.

The driving apparatus comprises a first plunger cylinder A, a second plunger cylinder B, a third plunger cylinder C, and a fourth plunger cylinder D.

The plunger cylinders A–D each contain a cylinder 3*a*–3*d*, a piston 4*a*–4*d* having a scavenging bore 5*a*–5*d*, as well as a cylinder chamber connection 6*a*–6*d* for the cylinder chamber 7*a*–7*d* and a scavenging duct connection 8*a*–8*d*.

Figure 2:
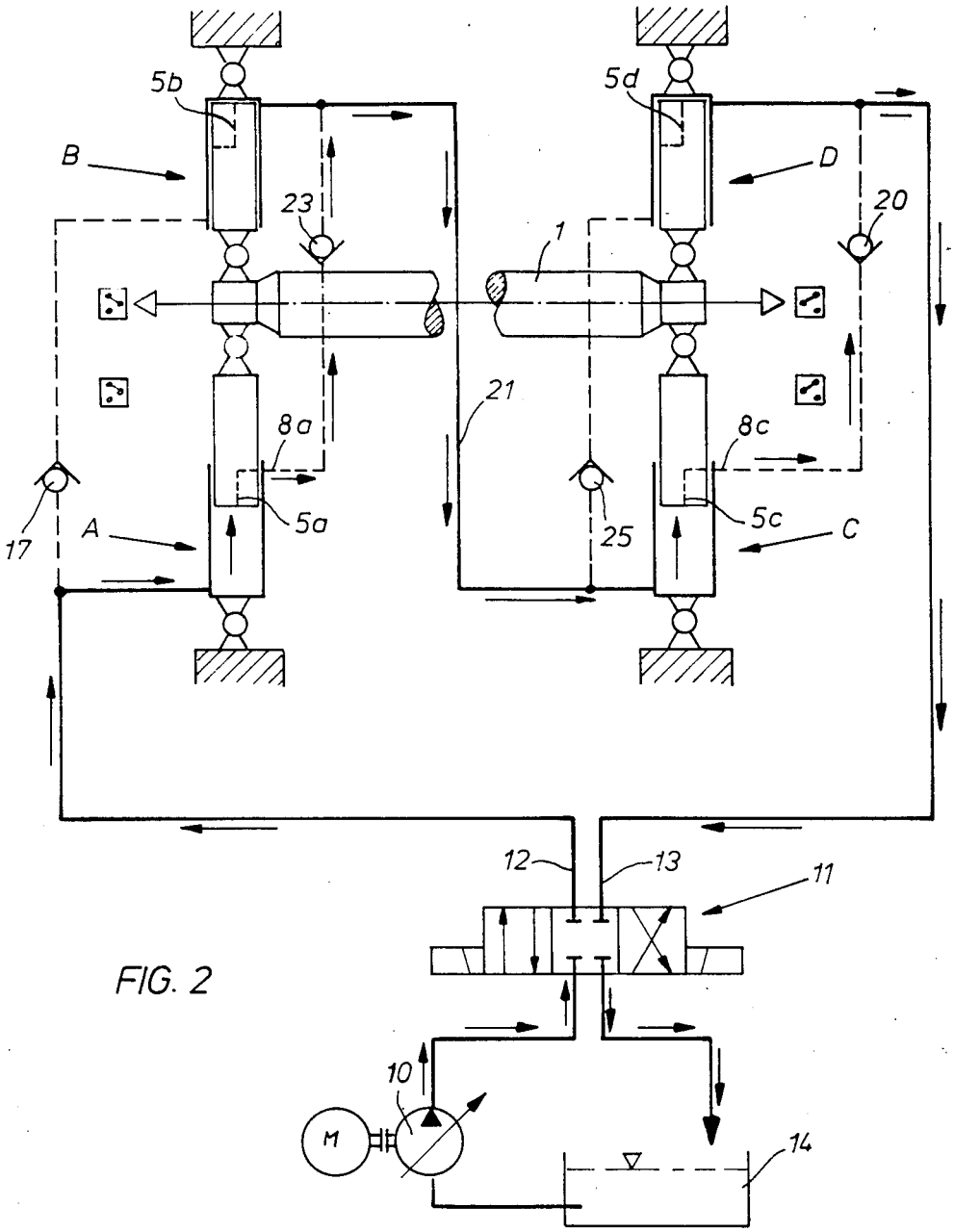

The scavenging duct connection 8*a*–8*d* is located in the wall of the cylinder 3*a*–3*d* at a point which is reached by the transverse part of the scavenging bore 5*a*–5*d* when the relevant piston 4*a*–4*d* reaches its end position (see FIG. 2).

The pressure medium is supplied to the driving apparatus by a pump 10 driven by a motor 9 via a 4/3-way valve 11 and two pressure medium connections 12 and 13. The pressure medium flows back into a storage tank 14.

The first pressure medium connection 12 is connected via a pipe 15 directly to the cylinder chamber connection 6*a* of the plunger cylinder A. It is also connected via a pipe 16 and a first non-return valve 17 to the scavenging duct connection 8*b* of the plunger cylinder B.

The second pressure medium connection 13 is connected via a pipe 18 directly to the cylinder chamber connection 6*d* of the plunger cylinder D, and via a pipe 19 and a second non-return valve 20 arranged therein to the scavenging duct connection 8*c* of the plunger cylinder C.

The cylinder chamber connections 6*b* and 6*c* of the plunger cylinders B and C are connected to one another via a connecting pipe 21 to which the scavenging duct connection 8*a* of the plunger cylinder A is connected via a pipe 22 with a third non-return valve 23 and the scavenging duct connection 8*d* of the plunger cylinder D is connected via a pipe 24 with a fourth non-return valve 25.

The four non-return valves 17, 20, 23 and 25 are arranged in such a way that the non-return valves 20 and 23 are penetrable when the first pressure medium connection 12 is under pressure and the scavenging bores 5*a*, 5*c* in the pistons of the plunger cylinders A and C have reached the appertaining scavenging duct connections 8*a* and 8*c* respectively (see FIG. 2), while the non-return valves 17 and 25 are penetrable when the second pressure medium connection 13 is under pressure and the scavenging bores 5*b*, 5*d* in the pistons 4*b*, 4*d* of the plunger cylinders B and D have reached the appertaining scavenging duct connections 8*b*, 8*d*.

In order to define the to-and-fro movement of the driven machine part, i.e., the drive shaft 1, switches 26, 27 and 28, 29 are provided which are actuated in known manner without contact via switch lugs 30, 31 mounted on the drive shaft 1

The control valve 11 is a 4/3-way valve with four connections (12, 13 and 32, 33) and three switch positions. In the left-hand switch position the pressure medium connection 12 is under pressure; in the right-hand switch position the pressure medium connection 13 is under pressure; and in the central switch position the pressure medium supply to the driving apparatus is interrupted.

Figure 1:
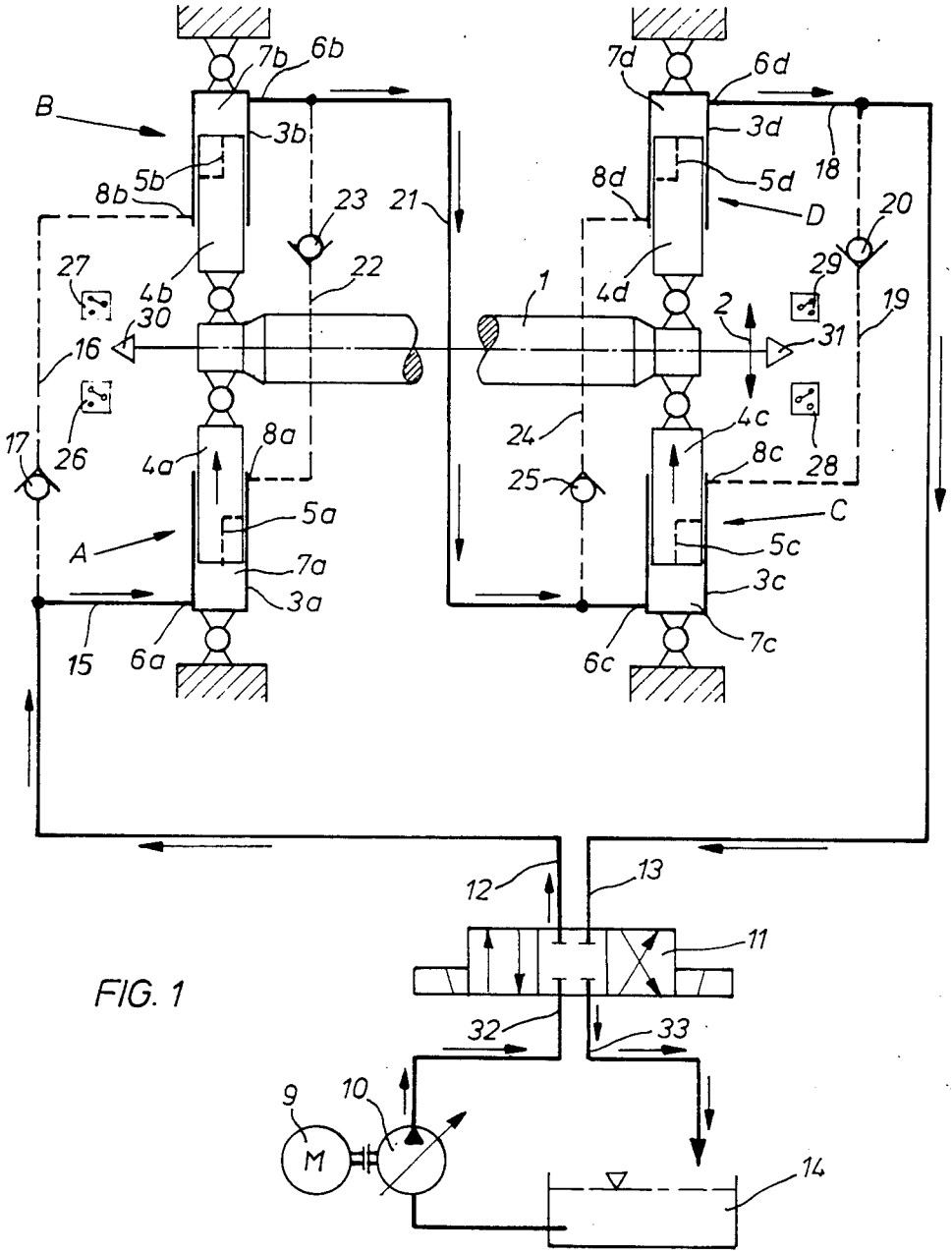

FIG. 1 shows the flow of pressure medium during the working stroke, in which the drive shaft 1 is moved upwards as (viewed in the drawing) by the plunger cylinders A and C. If, as a result of the supply of a certain quantity of pressure medium, the piston 4*a* of the cylinder A moves upwards in the cylinder chamber 7*a*, the piston 4*b* of the cylinder B compresses the same quantity of pressure medium in the cylinder C. The same quantity is pushed back out of the cylinder D into the storage tank 14. Thus all four pistons cover the same distance, so that the drive shaft 1 always carries out a parallel movement irrespective of the size and distribution of the forces acting upon it.

When they reach the end position (see FIG. 2) the scavenging bores 5*a* and 5*c* of the pistons 4*a* and 4*c* coincide with the scavenging duct connections 8*a* and 8*c* in the cylinders A and C. The stream of pressure medium now opens the non-return valves 23 and 20, while the non-return valves 17 and 25 remain closed. The plunger cylinders A and C and all connecting pipes are scavenged until the 4/3-way valve 11 is switched over (that is to say so long as the pressure medium connection 12 continues to be supplied with pressure medium)

After the 4/3-way valve 11 has been switched over (so that the pressure medium connection 13 is now supplied with pressure medium) the return stroke is carried out according to the same principle, that is, the plunger cylinder D is supplied with pressure medium and the plunger cylinder B undergoes corresponding admission of the pressure medium compressed by the plunger cylinder C.

In the end position of the working stroke illustrated in FIG. 1 the scavenging bores 5*b*, 5*d* of the plunger cylinders B and D are closed and the non-return valves 17 and 20 are closed by the rising pressure of the pressure medium. In this way starting for the return stroke is possible without difficulty.

Overflowing of the pressure medium into the scavenging ducts 16, 19, 22, 24 over the whole stroke is excluded. Any leakage losses which may occur are automatically compensated for by the scavenging effect in the piston end positions.

We claim:

1. In driving apparatus for producing to-and-fro movements of a driven machine part and including:

(a) four single acting rams which form two groups each of which has two rams acting in opposite directions, (b) first and second pressure medium connections connected via a control valve operable alternately to connect said pressure medium connections to a pressure medium supply and a pressure medium discharge and, (c) a plurality of non-return valves, the improvement wherein:

(d) the four rams are formed by cylinders in each of which is a piston having a scavenging bore, each of the cylinders having a cylinder chamber connection and each also having, in a part of the cylinder covered by the associated piston, a scavenging duct connection, so that when a certain piston position is reached the scavenging bore connects the cylinder chamber to the scavenging duct connections, (e) the first pressure medium connection is connected directly to the cylinder chamber connection of a first cylinder, and via a first non-return valve to the scavenging duct connection of a second cylinder which acts in the opposite direction to the first cylinder;

(f) the second pressure medium connection is connected via a second non-return valve to the scavenging duct connection of a third cylinder which works parallel to the first cylinder, and is directly connected to the cylinder chamber connection of a fourth cylinder which works in the opposite direction to the third cylinder;

(g) the cylinder chamber connections of the second and third cylinders are connected to one another via a connecting pipe to which the scavenging duct connection of the first cylinder is connected via a third non-return valve, and the scavenging valve connection of the fourth cylinder is connected via a fourth non-return valve; and (h) the four non-return valves are connected to the respective cylinders in such manner that the second and third non-return valves are penetrable when the first pressure medium connection is under pressure and the scavenging bores in the pistons of the first and third cylinders have reached the appertaining scavenging duct connections, while the first and fourth non-return valves are penetrable when the second pressure medium connection is under pressure and the scavenging bores in the pistons of the second and fourth cylinders have reached the appertaining scavenging duct connections.

2. Driving apparatus according to claim 1 including limit switches operable by the driven machine part to define the limits of the to-and-fro movement thereof.

3. Driving apparatus according to claim 1 wherein the control valve comprises a 4/3-way valve with four pressure medium connections and three switch positions.

4. Driving apparatus according to claim 1 wherein the driven machine part comprises a drive shaft of a thrust grate cooler.

* * * * *